US006626772B1

(12) United States Patent
Kennedy, III

(10) Patent No.: US 6,626,772 B1
(45) **Date of Patent: *Sep. 30, 2003**

(54) GOLF BALL WITH ELEVATED DIMPLE PORTIONS

(75) Inventor: Thomas J. Kennedy, III, Wilbraham, MA (US)

(73) Assignee: The Top-Flite Golf Company, Chicopee, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/597,009

(22) Filed: Jun. 20, 2000

(51) Int. Cl.[7] ..... A63B 37/14
(52) U.S. Cl. ..... 473/384
(58) Field of Search ..... 473/377, 378, 473/383, 384

(56) References Cited

U.S. PATENT DOCUMENTS 922,773 A * 5/1909 Kempshall ..... 473/384
4,787,638 A * 11/1988 Kobayashi ..... 473/384
5,470,076 A * 11/1995 Cadorniga ..... 473/383
5,536,013 A * 7/1996 Pocklington ..... 473/384
5,916,044 A * 6/1999 Shimosaka et al. ..... 473/384
5,957,787 A * 9/1999 Hwang ..... 473/379
6,010,442 A * 1/2000 Lemons et al. ..... 473/378
6,139,448 A 10/2000 Sullivan
6,162,136 A * 12/2000 Aoyama ..... 473/383
6,179,731 B1 1/2001 Shimosaka et al.

* cited by examiner

*Primary Examiner*—Steven Wong
*Assistant Examiner*—Raeann Gorden

(57) ABSTRACT

A new dimple configuration for the surface of a golf ball is characterized by a portion extending above the surface of the ball. Each dimple includes an annular portion having an inner configuration and an outer configuration, and an inner portion having a configuration corresponding with the annular portion inner configuration. Preferably, the annular portion is elevated relative to the ball surface. When a struck ball travels through the air, the elevated portions trip air at the ball surface to improve the flight characteristics of the ball.

13 Claims, 6 Drawing Sheets

FIG. 2
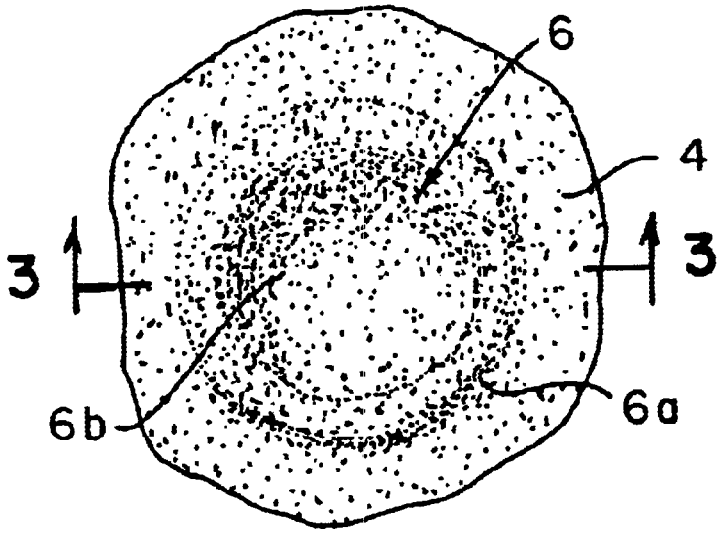
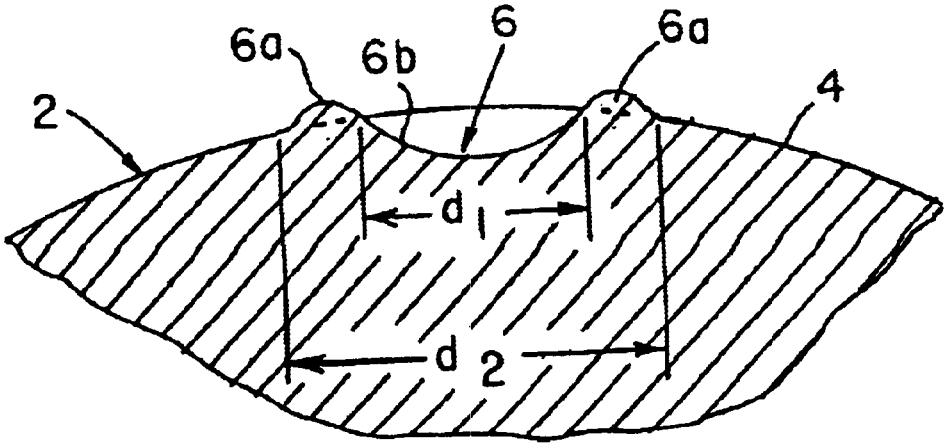
FIG. 3

FIG. 4
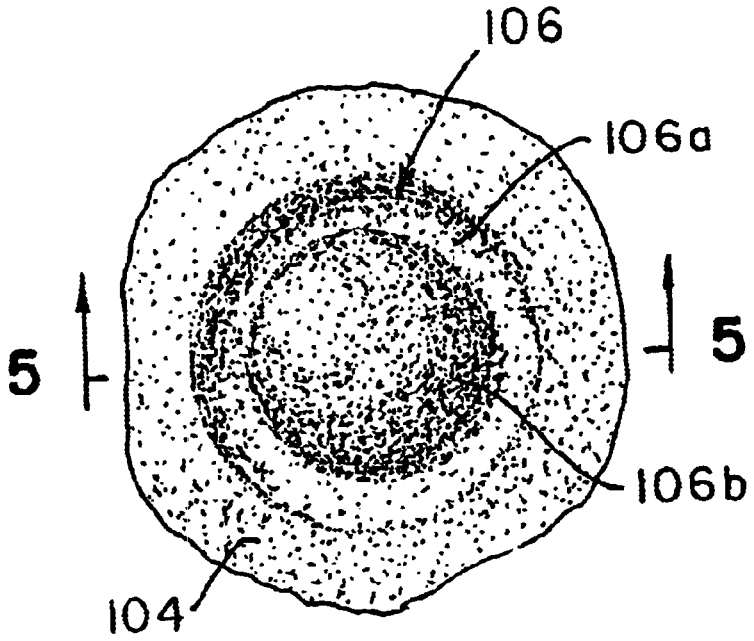
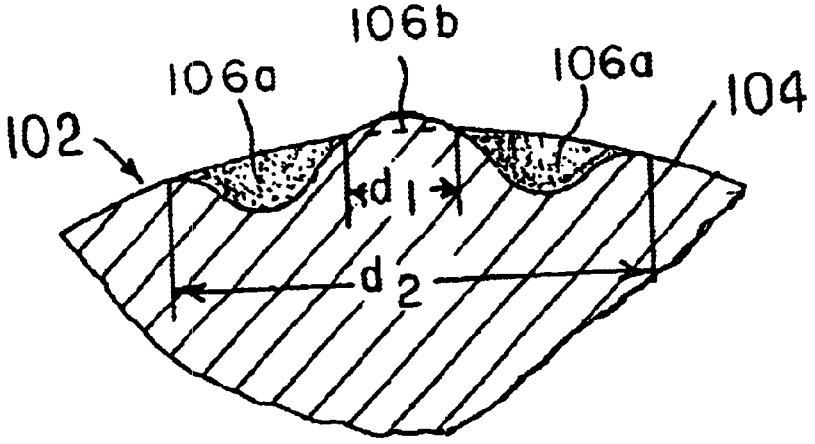
FIG. 5

GOLF BALL WITH ELEVATED DIMPLE PORTIONS

BACKGROUND OF THE INVENTION

The present invention relates to a new configuration for the dimples on a golf ball surface which improve the flight characteristics of the ball.

According to United States Golf Association (U.S.G.A.) rules, a golf ball may not have a weight in excess of 1.620 ounces or a diameter smaller than 1.680 inches. The initial velocity of balls conforming to U.S.G.A. regulations may not exceed 250 feet per second with a maximum tolerance of 2%. Initial velocity is measured on a standard machine kept by the U.S.G.A. A projection on a wheel rotating at a defined speed hits the test ball, and the length of time it takes the ball to traverse a set distance after impact is measured. U.S.G.A. regulations also require that a ball not travel a distance greater than 280 yards when hit by the U.S.G.A. outdoor driving machine under specified conditions. In addition to this specification, there is a tolerance of plus 4% and a 2% tolerance for test error.

These specifications limit how far a struck golf ball will travel in several ways. Increasing the weight of a golf ball tends to increase the distance it will travel and lower the trajectory. A ball having greater momentum is better able to overcome drag. Reducing the diameter of the ball also has the effect of increasing the distance it will travel when hit. This is believed to occur primarily because a smaller ball has a smaller projected area and, thus, a lower drag when traveling through the air. Increasing initial velocity increases the distance the ball will travel.

Drag on a golf ball is also reduced by forming a plurality of dimples, generally circular, in the outer surface of the ball. The dimples serve to reduce the pressure differential between the front and rear of the ball as it travels through air.

BRIEF DESCRIPTION OF THE PRIOR ART

Numerous dimple configurations for use on golf balls are well-known in the patented prior art. The Kempshall U.S. Pat. No. 922,773, for example, discloses a golf ball having circular recesses in the surface thereof, with a central protuberance being arranged within each recess. In one embodiment, an outer band projects from the surface of the ball around each recess. The Kobayashi U.S. Pat. No. 4,787,638 discloses a golf ball having a plurality of first circular dimples formed in the outer shell of the ball and a plurality of secondary dimples arranged within the first dimples. This arrangement produces a turbulent air flow boundary layer at the surface of the ball when it travels at lower air speeds.

While these dimpled golf balls of the prior art differ from the more conventional circular dimpled balls, they have not achieved sufficient results as to attain acceptance in the marketplace. The present invention was developed in order to create a dimpled golf ball with improved flight characteristics which also conforms with U.S.G.A. standards.

SUMMARY OF THE INVENTION

Accordingly, it is a primary object of the present invention to provide a golf ball having a spherical surface with a plurality of uniquely configured dimples thereon. Each dimple includes a generally annular portion having an inner configuration and an outer configuration, one of the configurations being non-circular. Each dimple further including an inner portion having an outer configuration corresponding with the inner configuration of the annular portion. At least one of the annular and inner portions extends above the surface of the golf ball.

It is yet another object of the invention to provide a golf ball wherein the dimples comprise at least two groups. The first group of dimples each has an annular portion having a first configuration and the second group of dimples each has an annular portion having a second outer configuration.

BRIEF DESCRIPTION OF THE FIGURES

Other objects and advantages of the invention will become apparent from a study of the following specification when viewed in the light of the drawing, in which:

FIG. 2 is a detailed plan view of a dimple according to a preferred embodiment of the invention;

FIG. 3 is a sectional view taken along line 3—3 of FIG. 2;

FIG. 4 is a detailed plan view of a first alternate dimple according to the invention;

FIG. 5 is a sectional view taken along line 5—5 of FIG. 4;

DETAILED DESCRIPTION

Figure 1:
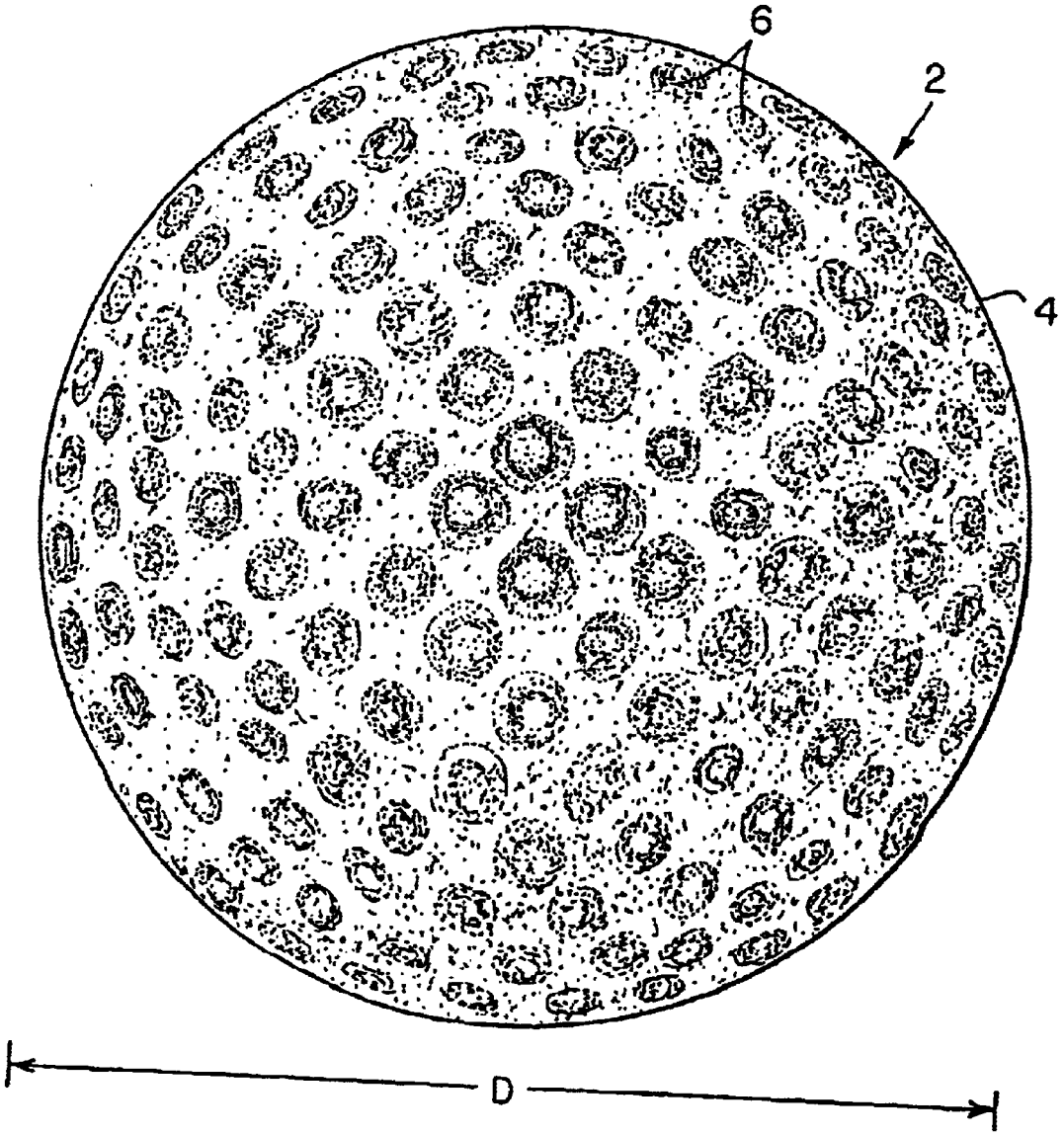
FIG. 1 is a plan view of a golf ball containing dimples with elevated portions according to the invention.

In FIG. 1 there is shown a golf ball 2 having a spherical surface 4 in which are formed a plurality of dimples 6. At least a portion of each dimple is elevated relative to the spherical surface as will be developed below.

Referring now to FIGS. 2 and 3, the preferred embodiment of the invention will be described. The dimple 6 comprises two portions, namely an outer annular portion **6*a* and an inner circular portion 6*b*. The annular portion 6*a* has an inner diameter $d_1$, and an outer diameter $d_2$, while the circular portion 6*b* has a diameter corresponding with the annular portion inner diameter $d_1$. The annular portion 6*a* has a convex outer surface which is elevated or raised with respect to the golf ball surface 4 as shown in FIG. 3. Moreover, the circular portion 6*b* has a concave outer surface which is depressed or extends either to or below the golf ball surface 4**. Preferably, the radius of curvature of the circular portion is fixed.

The annular portion 6*a* which defines the outer edge of the dimple 6 is thus above the land area of conventional dimpled golf balls. This raised land area thus trips air flowing across the golf ball surface as the ball rotates through the air, thereby improving the aerodynamic properties of the ball. Where the concave circular portion 6*b* extends below the surface of the ball, the effect of the elevated annular portions 6*a*on the aerodynamics of the ball is enhanced.

Turning now to FIGS. 4 and 5, an alternate configuration for a dimple 106 according to the invention will be described. This configuration is essentially opposite that shown in FIGS. 2 and 3. That is, the annular portion 106*a* is concave and the circular portion 106*b* is convex and is elevated above the surface 104 of the golf ball 102 to trip air flowing across the ball surface. The inner diameter $d_1$ of the annular portion corresponds with the diameter of the circular portion. The annular portion may also extend below the golf ball surface as shown.

In order to comply with U.S.G.A. rules, the diameter of the golf ball including the dimples according to the invention, must have a diameter D of at least 1.680 inches. The diameter can be measured across the outer surface 4 of the golf ball of FIG. 1, whereby the dimples will include portions, either annular (FIGS. 2 and 3) or circular (FIGS. 4 and 5) which extend beyond the diameter. Thus, the diameter of the ball measured from the outermost dimple portions will be slightly greater than 1.680 inches. Alternatively, if the ball diameter is measured across the raised portions of the dimples, the diameter must be at least 1.680 inches. Thus, the ball diameter across the raised portions of the dimples must be at least 1.680 inches, but may be greater where the diameter is measured across the ball outer surface.

The dimples 6 may all have the same configuration and dimensions for the inner and outer diameters $d_1$, and $d_2$ of the annular portion. Alternatively, different sized dimples may be arranged on the ball. In FIG. 1, for example, there is shown a golf ball having a plurality of dimples of two different sizes. A first group of dimples A has an annular outer diameter less than that of a second group of dimples B. Any number of dimple sizes may be provided, and the number of dimples of each size need not be equivalent. This will facilitate the arrangement of dimples on the surface of the golf ball to maximize the percentage of dimple coverage on the ball. Dimples may also be provided having different inner diameters, whereby the widths of the annular portions among separate dimples will vary.

It is also possible to provide a golf ball with dimples of configurations of both FIGS. 3 and 5. That is, some dimples on a ball may have elevated annular portions and other dimples may have elevated center portions.

Figure 6:
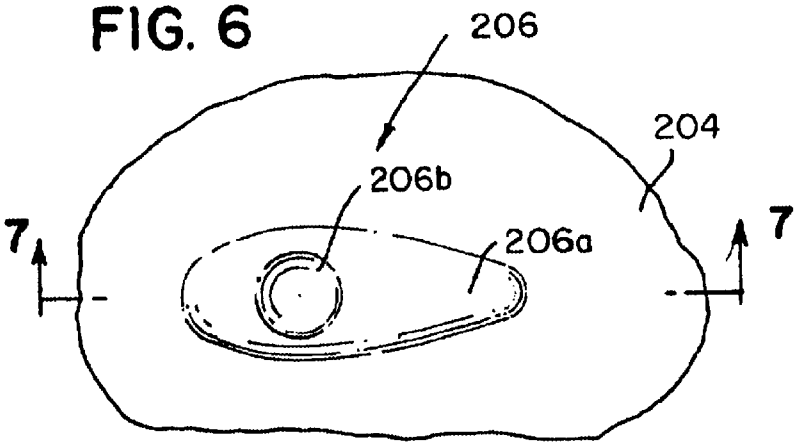
FIG. 6 is a detailed plan view of a second alternate dimple according to the invention.
Figure 7:
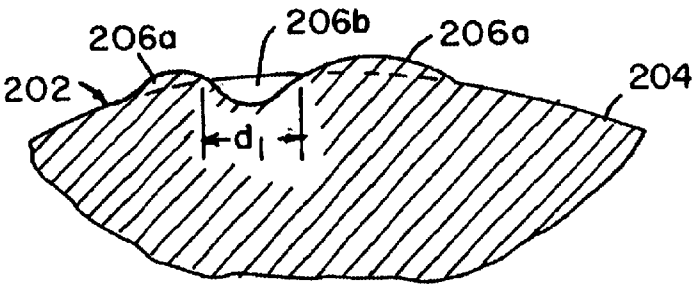
FIG. 7 is a sectional view taken along line 7—7 of FIG. 6.

In the embodiment shown in FIGS. 6 and 7, the golf ball 202 has a dimple 206 with a generally annular portion 206*a* and an inner portion 206*b*. The annular portion 206*a* has an elongated non-circular outer configuration as shown in FIG. 6 and extends above the dimple surface 204 as shown in FIG. 7. The inner portion 206*b* has a circular configuration with a my diameter $d_1$ corresponding with the inner diameter of the annular portion and has a concave configuration which is depressed below the golf ball surface 204.

Figure 8:
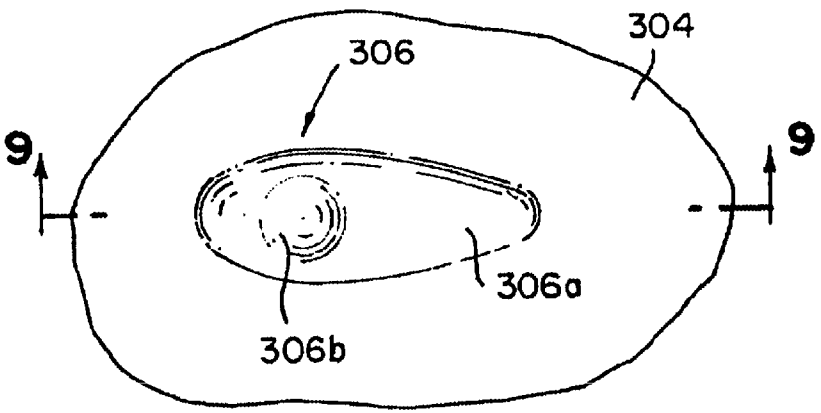
FIG. 8 is a detailed plan view of a third alternate dimple according to the invention.
Figure 9:
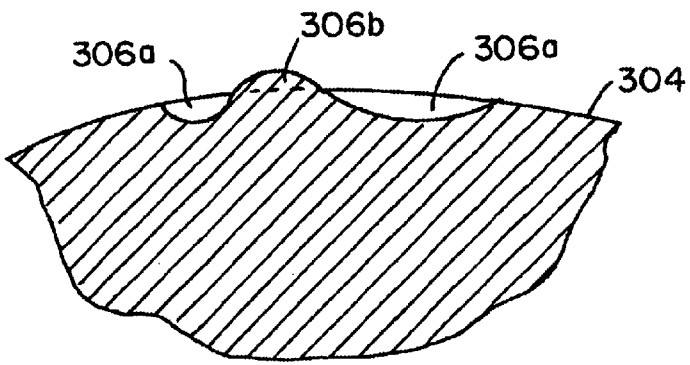
FIG. 9 is a sectional view taken along line 9—9 of FIG. 8.

The embodiment shown in FIGS. 8 and 9 is the opposite of that of FIGS. 6 and 7. That is, the annular portion 306*a* of the dimple 306 extends below the golf ball surface 304 and the inner portion 306*b* extends above the golf ball surface.

Figure 10:
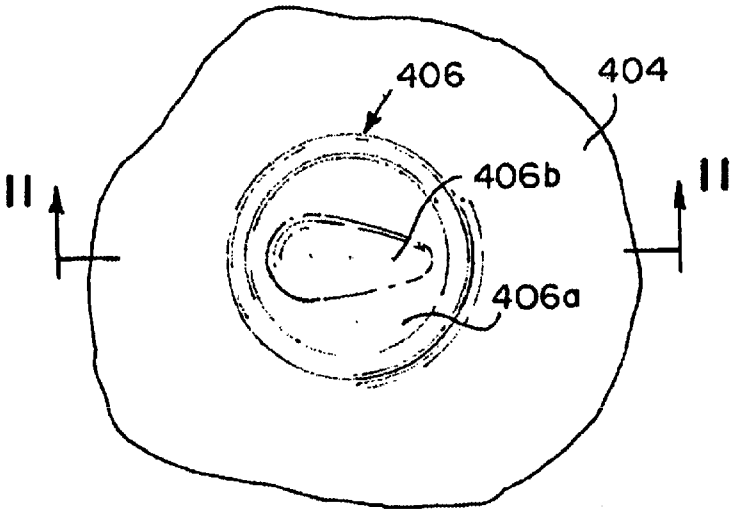
FIG. 10 is a detailed plan view of a fourth alternate dimple according to the invention.
Figure 11:
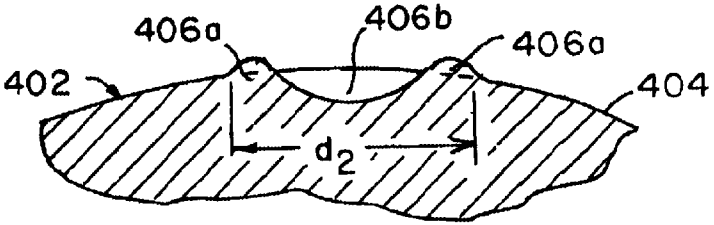
FIG. 11 is a sectional view taken along line 11—11 of FIG. 10.

In the embodiment of FIGS. 10 and 11, there is shown a golf ball 402 which has a dimple 406 with a generally annular portion 406*a* and an inner portion 406*b*. The annular portion 406*a* has a circular outer configuration with a diameter $d_2$ as shown in FIG. 10 and extends above the dimple surface 404 as shown in FIG. 1. The inner portion 406*b* has an elongated non-circular configuration and a concave configuration which is depressed below the golf ball surface 204.

Figure 12:
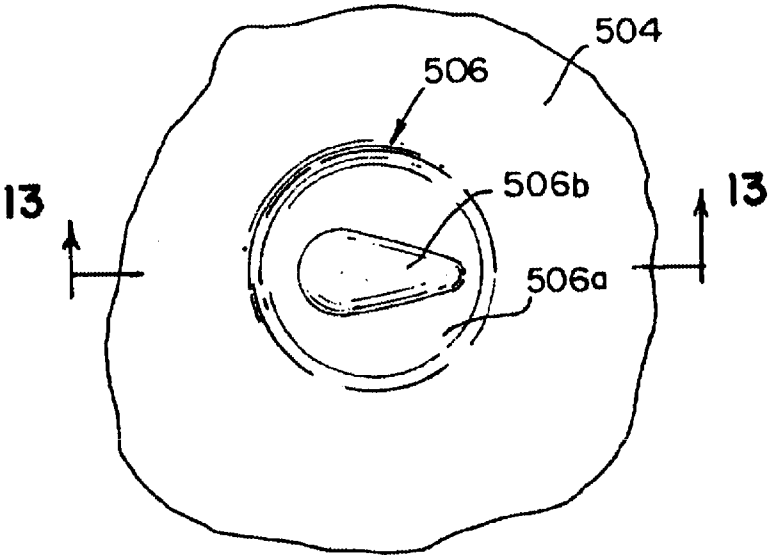
FIG. 12 is a detailed plan view of a fifth alternate dimple according to the invention.
Figure 13:
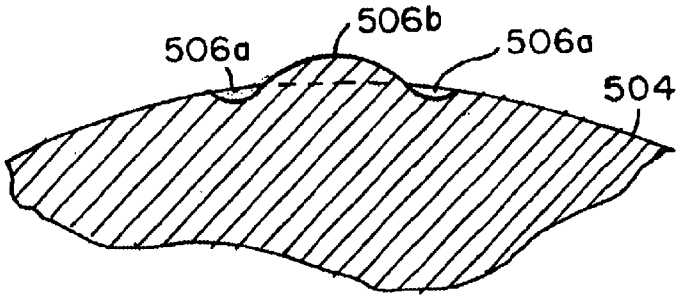
FIG. 13 is a sectional view taken along line 13—13 of FIG. 12.

The embodiment shown in FIGS. 12 and 13 is the opposite of that of FIGS. 10 and 11. That is, the annular portion 506*a* of the dimple 506 extends below the golf ball surface 504 and the inner portion 506*b* extends above the golf ball surface.

Figure 14:
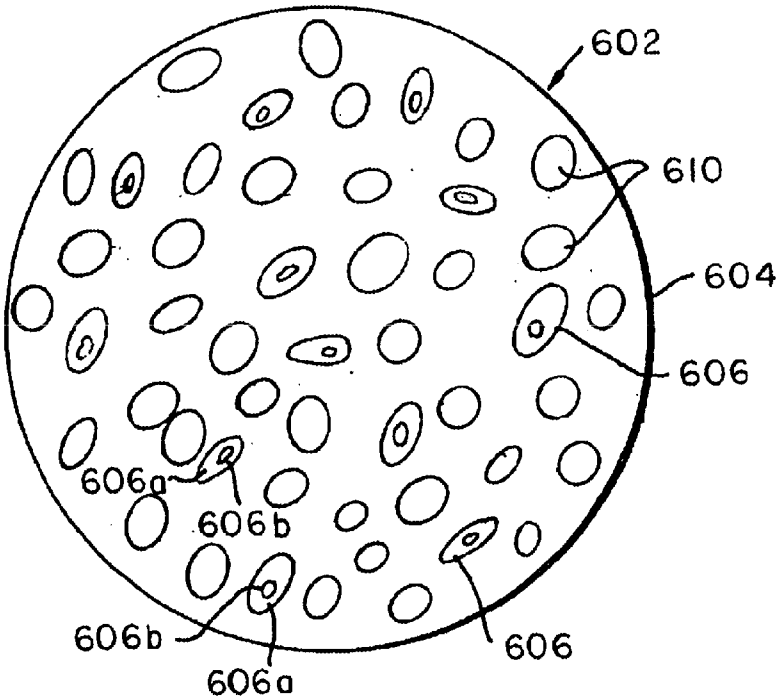

The golf ball 602 shown in FIG. 14 contains a plurality of conventional circular dimples 610 and a plurality of elevated dimples 606 comprising elongated non-circular annular portions 606*a* and circular inner portions 606*b*. Either the annular portion or the circular portion of the dimples 606 is elevated relative to the surface 604 of the ball. The elevated dimples are thus of the type shown in FIGS. 6–9. The golf ball 702 shown in FIG. 15 contains a plurality of elongated non-circular dimples 710 and a plurality of elevated dimples 706 comprising circular annular portions 706*a* and elongated non-circular inner portions 706*b*. Either the annular portion or the circular portion of the dimples 710 is elevated relative to the surface 604 of the ball, the elevated dimples being of the type shown in FIGS. 10–13. The elevated dimples are thus of the type shown in FIGS. 6–9. The golf ball 702 shown in FIG. 15 contains a plurality of non-circular dimples 710 and a plurality of elevated dimples 706 comprising circular annular portions 706*a* and non-circular inner portions 706*b*. Either the annular portion or the circular portion of the dimples 710 is elevated relative to the surface 604 of the ball, the elevated dimples being of the type shown in FIGS. 10–13.

Figure 15:
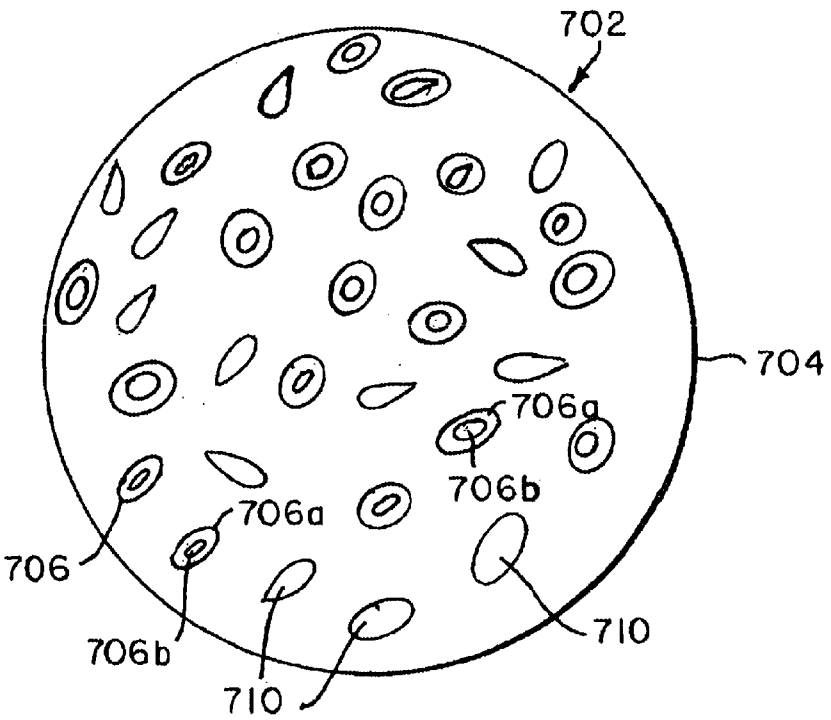
FIGS. 14 and 15 are plan views, respectively, of a golf ball including combinations of elevated and non-elevated dimples according to additional embodiments of the invention.

Golf balls having the combination of elevated and non-elevated dimples shown in FIGS. 14 and 15 have improved flight characteristics over golf balls with non-elevated dimples because of the alterations in the air currents at the surface of the ball as it travels through the air.

While in accordance with the provisions of the patent statutes, the preferred forms and embodiments of the invention have been illustrated and described, it will be apparent to those of ordinary skill in the art that various changes and modifications may be made without deviating from the inventive concepts set forth above.

What is claimed is:

1. A dimple in combination with a golf ball having a spherical surface, comprising (a) a generally annular portion having an inner configuration and an outer configuration, one of said inner and outer configurations being elongated and non-circular; and (b) an inner portion having an outer configuration corresponding with said inner configuration of said annular portion, at least one of said annular and inner portions extending above the surface of the golf ball, whereby a golf ball containing a plurality of dimples in the surface thereof has improved flight characteristics.

2. A dimple as defined in claim 1, wherein the other of said annular and inner portions extends below the surface of the golf ball.

3. A dimple as defined in claim 2, wherein said annular portion has a convex outer surface extending above the surface of the golf ball and said inner portion is concave and extends below the surface of the golf ball.

4. A dimple as defined in claim 3, wherein said concave inner portion has a fixed radius of curvature.

5. A dimple as defined in claim 2, wherein said annular portion is concave and extends below the surface of the golf ball and said inner portion is convex and extends above the surface of the golf ball.

6. A golf ball having a spherical surface, comprising a first plurality of dimples arranged in said surface, at least one of said dimples including:

(a) a generally annular portion having an inner configuration and an outer configuration, one of said configurations being elongated and non-circular; and (b) an inner portion having an outer configuration corresponding with said inner configuration of said annular portion, at least one of said annular and inner portions extending above the surface of the golf ball, whereby the golf ball has improved flight characteristics.

7. A golf ball as defined in claim 6, wherein the other of said annular and inner portions extends below the surface of the golf ball.

8. A golf ball as defined in claim 7, wherein said outer configuration of said annular portion of said first plurality of dimples has an elongated non-circular configuration and further comprising a plurality of second dimples having a circular configuration.

9. A golf ball as defined in claim 8, wherein said plurality of second dimples have the same diameter.

10. A golf ball as defined in claim 7, wherein said outer configuration of said annular portion of said first plurality of dimples has a circular configuration and further comprising a plurality of second dimples having an elongated non-circular configuration.

11. A golf ball as defined in claim 7, wherein said annular portion has a convex outer surface extending above the outer surface of the golf ball and said inner portion is concave and extends below the surface of the golf ball.

12. A golf ball as defined in claim 7, wherein said annular portion is concave and extends below the surface of the golf ball and said inner portion is convex and extends above the surface of the golf ball.

13. A golf ball as defined in claim 6, wherein none of the dimples overlap.

* * * * *